United States Patent [19]

Daniels

[11] Patent Number: 4,796,371

[45] Date of Patent: Jan. 10, 1989

[54] CARTRIDGE LOADER FOR REVOLVERS

[76] Inventor: Gary J. Daniels, 1712 Brinton Manor Dr., Pittsburgh, Pa. 15221

[21] Appl. No.: 193,603

[22] Filed: May 13, 1988

[51] Int. Cl.[4] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,964,171 | 6/1934 | Pflaume | 42/89 |
| 3,252,238 | 5/1966 | Bye | 42/89 |
| 4,030,222 | 6/1977 | Sommer | 42/89 |

*Primary Examiner*—Charles T. Jordan

*Attorney, Agent, or Firm*—Henderson & Sturm

[57] ABSTRACT

The cartridge loader comprises a body formed symmetrically about a central, upright axis and is provided with a number (here six) of vertical flutes opening radially outwardly of the holder and extending from top to bottom of the holder. The flutes are on parallel axes equi-angularly spaced about the central axis and each is configured to receive a cartridge, rim-up, and in such fashion that only a relatively minor portion of the cartridge rim rests on the holder top. A plurality of spring-biased fingers, equal in number and spacing to the flutes, engage and retain the cartridges in the flutes. A downwardly movable plunger is actuated to move the fingers radially outwardly in unison to release the cartridges into the cylinder of a revolver.

5 Claims, 1 Drawing Sheet

Fig. 2
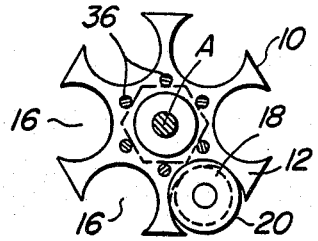
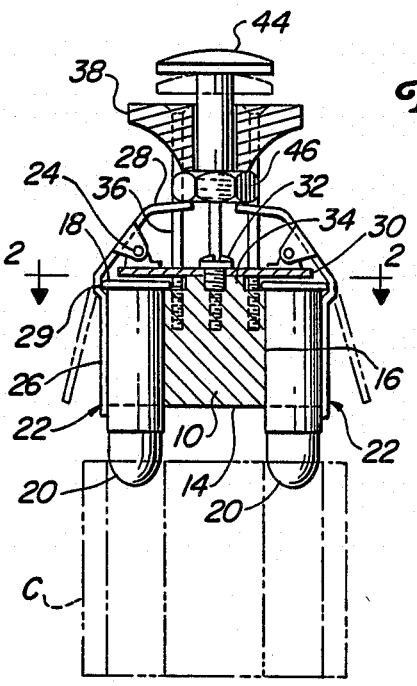
Fig. 1
Fig. 3
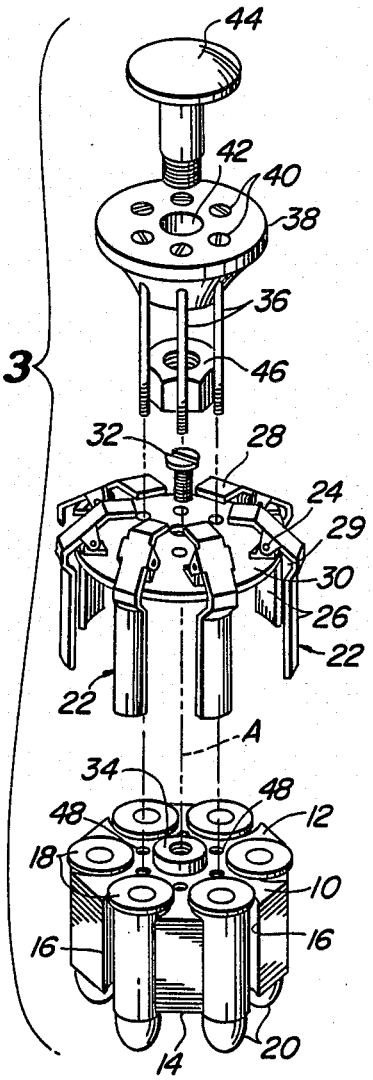
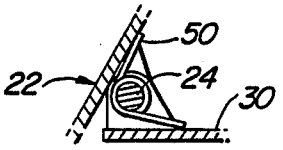
Fig. 4

CARTRIDGE LOADER FOR REVOLVERS

BACKGROUND AND SUMMARY OF THE INVENTION

Loaders for rapid loading of the cylinder of a revolver have been available for several years and all have in common some form of holder for releasably holding a number of cartridges equal in number to the chambers in the revolver cylinder, the principal of operation being that the cylinder may be quickly reloaded by simultaneous release of the cartridges from the holder, an expedient found to be significant in rapid firing of the revolver. Prior loaders predominantly use cylindrical holders having cylindrical chambers or bores from which the cartridges drop or are ejected from the interior of the cylinder. Typical of such prior loaders is the disclosure in the U.S. Pat. No. 1,946,171 to Pflaume.

The present invention provides a design that departs from prior designs by the utilization of a holder in which the cartridges are carried in a group of parallel flutes externally of and arranged in an annular pattern about the holder. Each flute is substantially semi-cylindrical and is so dimensioned relative to a receivable cartridge that only a very minor portion of the cartridge rim overhangs the top of the holder and is thus easily releasable from the holder upon outward actuation of a plurality of inwardly biased fingers, each of which extends downwardly alongside a cartridge. A simple plunger is manually operative to swing the fingers and thus to release the cartridges simultaneously into the chambers of the revolver cylinder. Further features of the invention reside in details of construction enabling the production and marketing of a simple and efficient loader that is easy to operate and is virtually fool-proof.

Other features and advantages of the invention will become apparent as a preferred embodiment of the invention is disclosed herein.

DESCRIPTION OF THE DRAWING

FIG. 1 is a section through the assembled loader.

FIG. 2 is a section as seen along the line 2—2 of FIG. 1.

FIG. 3 is an "exploded" perspective of the loader.

FIG. 4 is a fragmentary view, partly in section, showing the biasing means for a cartridge-retaining finger.

DETAILED DESCRIPTION OF A PREFERRED EMBODIMENT OF THE INVENTION

The loader will be described with regard to a vertical orientation in order to render easier an understanding of the relation of its parts to each other and also because, in use in loading the cylinder of a revolver, its position will be essentially vertical as the cartridges drop into the cylinder chambers, all of which does not mean that the specific reference to the vertical imposes any limitation on the significant aspects of the invention.

The main supporting or body part of the loader is a holder (10) of any suitable material formed symmetrically about a vertical axis A and having a top (12) and a bottom (14). Grouped about the axis A on a plurality of parallel axes are a number of flutes (16), here six in number to accord with the usual number of chambers in a revolver cylinder, the association of which with the loader is indicated at C in broken lines in FIG. 1. The flutes run from top to bottom of the holder and each is of substantially semi-cylindrical configuration as best seen in FIG. 2, which gives the holder the appearance of a six-spoked "wheel". The configuration and dimension of each flute are such relative to a cartridge to be received thereby that the cartridge is relatively loosely received in the flute so that only a very minor portion of a rim (18) of a cartridge (20) rests atop the holder. Note FIGS. 1 and 2. In the present case, the holder is designed to handle rounds for a .41 Magnum. Hence, the flutes or pockets are one-half inch in "diameter" (one-quarter inch radius). Each cartridge, when seated in its flute, has vertical line contact with its flute. The rim of the cartridge is also one-half inch in diameter and the overhang of the rim at the top of the holder is only about forty percent of the rim diameter. It will be seen that, without more, the cartridges are poised to drop from the flutes with but little impetus.

As means for engaging the cartridges so as to retain them in place in the holder until ready for cylinder loading, the holder carries six fingers (22), each in the form of a lever pivoted at (24) and having a lower portion (26) normally lying alongside a cartridge and an upper portion (28) capable of receiving manual force for releasing the cartridges. Each finger, just below its pivot, is configured to provide a recess (29) for engaging the proximate portion of a cartridge rim, thus combining with the top of the holder as cartridge-retaining means. The fingers are carried by their pivots (24) in equi-angularly spaced relation on a support or platform (30) secured centrally to the top of the holder by a screw (32). The platform is spaced above the top of the holder by a central spaced portion (34) so as to afford vertical clearance for the cartridge rims.

The platform is further fixed against rotation relative to the holder by six upright elements, each in the form of a long, slender screw (36) having a lower end passed through the platform and threaded into the top of the holder. As seen in FIG. 2, the screws are arranged in a hexagonal pattern, a design dictated by the number of flutes, for example. The tops of the screws are headed and serve to retain a fixed knob or grip element (38). The tops of the screws are seen at (40) in FIG. 3. The knob is centrally bored on the axis A at (42) and vertically slidably carries the stem of a plunger (44), the head of which projects above the knob and the lower end of which has a member (46) operative to engage and rock the upper ends of the release fingers. As already noted, the screws (36) are arranged in a hexagonal pattern about the axis A. The member (46) on the bottom of the plunger is a hexagonal nut whose six flat sides lie closely proximate to and are surrounded by the screws so as to be guided by the screws and prevented from loosening. See FIG. 2. Tapped bores (48) for the screws (36) are best seen in FIG. 3.

The manner in which the underside of the plunger nut (46) engages the upper arms of the release fingers is best seen in FIG. 1. The mounting of each finger includes biasing means such as a spring (50) (FIG. 4) so that each finger is biased to cartridge-engaging position. The biasing action also acts to project the plunger upwardly, from which it may be manually depressed to spread the fingers and thus release the cartridges simultaneously. Manipulation is easily effected by the user placing two fingers beneath the knob and pressing on the plunger with his thumb. For reloading the holder, it is expedient to invert the holder so that new rounds can be inserted downwardly, rim-end first. The dimension of the platform (30) is such that it overlaps the top ends of the flutes and, as mentioned before, is spaced above the top of the holder to accommodate the cartridge rims. The platform, in this fashion, serves also as a stop for the cartridges when reloaded into the inverted holder. Further, as each cartridge is so loaded, its finger (22) is individually yieldable outwardly in response to the rim of downwardly moving cartridge and will snap back once the rim is seated in the finger recess (29). At this point, it should be noted that the fingers extend downwardly past their recesses in order to stabilize the cartridges in the holder.

It will thus be seen that the inventive design has many features, such as the outward releasing movement of the fingers, the knob and plunger relationship, the mounting of the fingers, guiding of the plunger and others that will readily occur to those versed in the art, along with modification in the preferred embodiment disclosed, all without departure from the spirit and scope of the invention.

I claim:

1. A cartridge loader for revolvers, comprising a holder formed symmetrically about a vertical central axis and having a top, a bottom and a plurality of flutes of substantially semi-cylindrical configuration arranged respectively on axes parallel to the central axis and equally angularly spaced about said axis and opening radially outwardly of the holder as well as at the top and bottom of the holder, each flute being dimensioned to receive a cartridge with a portion of the cartridge rim resting on a portion of the holder top adjacent to the associated flute, a support disposed coaxially with the holder and carried by the holder top, a plurality of fingers equal in number and angular spacing to the flutes and arranged about the support to extend normally downwardly respectively outwardly of and alongside the flutes for respectively engaging flute-carried cartridges, means biasing the fingers inwardly toward the holder for confining the cartridges to the flutes, means mounting the fingers on the support for selective outwardly swinging away from the flutes for releasing the cartridges for downward exit from the flutes, a grip member spaced coaxially above the support and fingers and having central bore, a plurality of upright mounting elements arranged in equal angularly spaced relation about the holder axis and having lower ends extending through the support and into the holder and upper ends extending into the grip member for securing the grip member to the holder, and means for engaging and moving the fingers comprising a plunger axially slidable in the bore of the grip member and having an upper end projecting above the grip member and a lower end engaging the fingers whereby the plunger is normally biased axially upwardly via the fingers and finger-biasing means and is movable manually downwardly relative to the grip member for actuating the fingers.

2. A cartridge loader according to claim 1, in which the finger-mounting means includes a plurality of pivots, one for each finger, and each finger is a lever mounted on its pivot and having a lower arm cartridge-engaging and an upper arm engageable by the lower end of the plunger.

3. A cartridge loader according to claim 1, in which the lower end of the plunger is disposed centrally within the upright elements.

4. A cartridge loader according to claim 3, in which the upright elements are six in number and arranged in a hexagonal pattern about the holder axis, and the lower end of the plunger carries a hexagonal member whose flat sides lie respectively proximate to the upright elements.

5. A cartridge loader according to claim 1, in which the upright elements are screws, the lower end of each element screw passes through the support and is threaded into the holder, and the upper end of each element screw is headed and engages the grip element from above.

* * * * *